US010003156B1

(12) United States Patent
Rengifo

(10) Patent No.: US 10,003,156 B1
(45) Date of Patent: Jun. 19, 2018

(54) QUICK-CONNECT MATING POST

(71) Applicant: TE CONNECTIVITY CORPORATION, Berwyn, PA (US)

(72) Inventor: Alex Robert Rengifo, Oceanside, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/677,483

(22) Filed: Aug. 15, 2017

(51) Int. Cl.
*H01R 13/627* (2006.01)

(52) U.S. Cl.
CPC ..... *H01R 13/6275* (2013.01)

(58) Field of Classification Search
CPC ..... H01R 13/6275; H01R 13/6215; H01R 13/213; H01R 13/621
See application file for complete search history.

(56) References Cited

U.S. PATENT DOCUMENTS 4,207,655 A * 6/1980 MacMaster ..... F16B 5/10 292/62
6,273,742 B1 8/2001 Castagna et al.
7,448,823 B2 * 11/2008 Silva ..... F16G 15/06 403/325
8,092,246 B1 1/2012 Santiago
8,931,973 B2 * 1/2015 Olszewski ..... A61G 13/101 285/396
9,293,858 B2 3/2016 Iikhanov et al.
2006/0099838 A1 * 5/2006 Meyers ..... E02F 9/006 439/134

FOREIGN PATENT DOCUMENTS

EP 1491295 A1 * 12/2004 ..... B25B 27/10

OTHER PUBLICATIONS

"ABC Series Modular and In-Line Composite Connectors" Brochure, 8 pgs, Nov. 2015.

* cited by examiner

*Primary Examiner* — Briggitte R Hammond

(57) ABSTRACT

A mating post and method to retain a first electrical connector to a second electrical connector. The mating post includes a head, a neck portion and a locking portion. The neck portion is configured to be received in a mounting opening of the first connector. The locking portion extends from the neck portion in a direction away from the head. At least one slot is provided in the locking portion. The at least one slot projects from proximate a free end of the locking portion toward the neck portion. A projection receiving recess extends from the at least one slot to cooperate with a projection of the second connector to secure the first connector to the second connector.

19 Claims, 5 Drawing Sheets

QUICK-CONNECT MATING POST

FIELD OF THE INVENTION

The invention is directed to a mating post and method used to mate a first electrical connector to a second electrical connector. In particular, the invention is directed to a quick-connect, light weight, self-aligning post which can be used to mate a first micro-D connector to a second micro-D connector.

BACKGROUND OF THE INVENTION

Multiple mating and unmating of connectors, such as Micro-D connectors, during testing and/or in the field require that the two mating halves be fastened with hardware, such as jackscrews. As the jackscrews are located at either end of the connector, the user must switch back and forth between the jackscrews as they are tightened to prevent binding of the connectors. In addition, the jackscrews or other mounting hardware are made of metal or the like, which contributes significantly to the overall weight of the connector.

As size and weight are often important considerations when selecting a connector, it would be beneficial to provide a mating post for the connector which is light weight to reduce the overall weight of the connector. It would also be beneficial to provide a mating post which can be quickly, easily and effectively moved into a locked position, without the need for the back and forth motion between the jackscrews.

SUMMARY OF THE INVENTION

An embodiment is directed to a mating post for use to retain a first electrical connector to a second electrical connector. The mating post includes a head, a neck portion and a locking portion. The neck portion is configured to be received in a mounting opening of the first connector. The locking portion extends from the neck portion in a direction away from the head. At least one slot is provided in the locking portion. The at least one slot projects from proximate a free end of the locking portion toward the neck portion. A projection receiving recess extends from the at least one slot to cooperate with a projection of the second connector to secure the first connector to the second connector.

An embodiment is directed to an electrical connector. The electrical connector includes a housing having a flange with a first surface and an oppositely facing second surface. The flange has mounting openings which extend through the flange from the first surface to the second surface. Mating posts are provided and are retained in the mounting openings of the housing. The mating posts have slots which project from proximate free ends of the mating posts toward ends of the mating posts that are positioned proximate the housing. Projection receiving recesses extend from the mounting slots to cooperate with projections of a mating connector to secure the housing to the mating connector. Springs are positioned between the first surface of the flange and heads of the mating posts positioned at the ends of the mating posts that are positioned proximate the housing. The springs are configured to provide an axial spring force between the heads of the mating posts and the housing.

An embodiment is directed to a method of retaining a first electrical connector to a second electrical connector. The method includes: aligning slots in a mating post with first projections in a first mounting opening of the first connector; inserting the mating post through the first mounting opening of the first connector; and rotating the mating post relative to the first mounting opening of the first connector to secure the mating post in the first mounting opening of the first connector. The method also includes: aligning the slots in the mating post with second projections in a second mounting opening of the second connector; inserting the mating post through the second mounting opening of the second connector; and rotating the mating post relative to the second mounting opening of the second connector to position the second projections in projection receiving recesses of the mating post which extend from the slots. The mating post is secured in the second mounting opening of the second connector while maintaining the mating post in the first mounting opening of the first connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
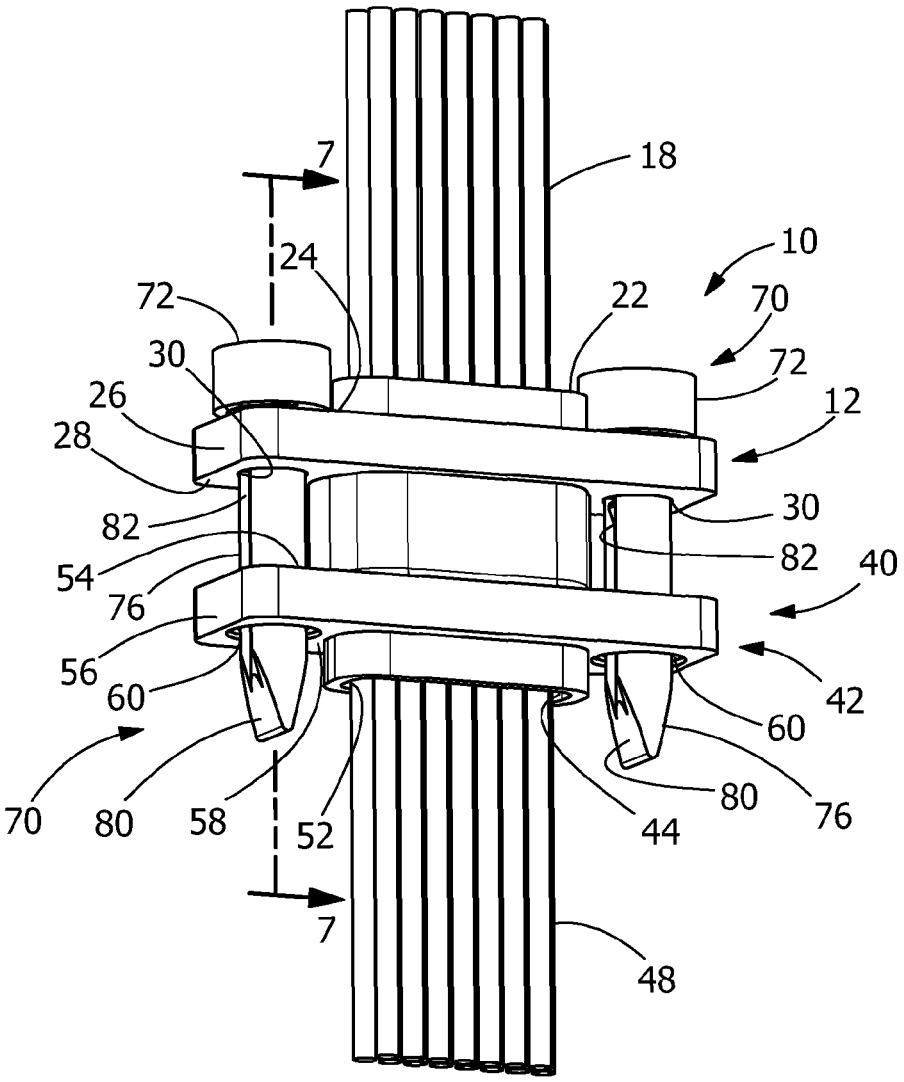
FIG. 1 is a front perspective view an illustrative first connector mated to a second connector.
Figure 2:
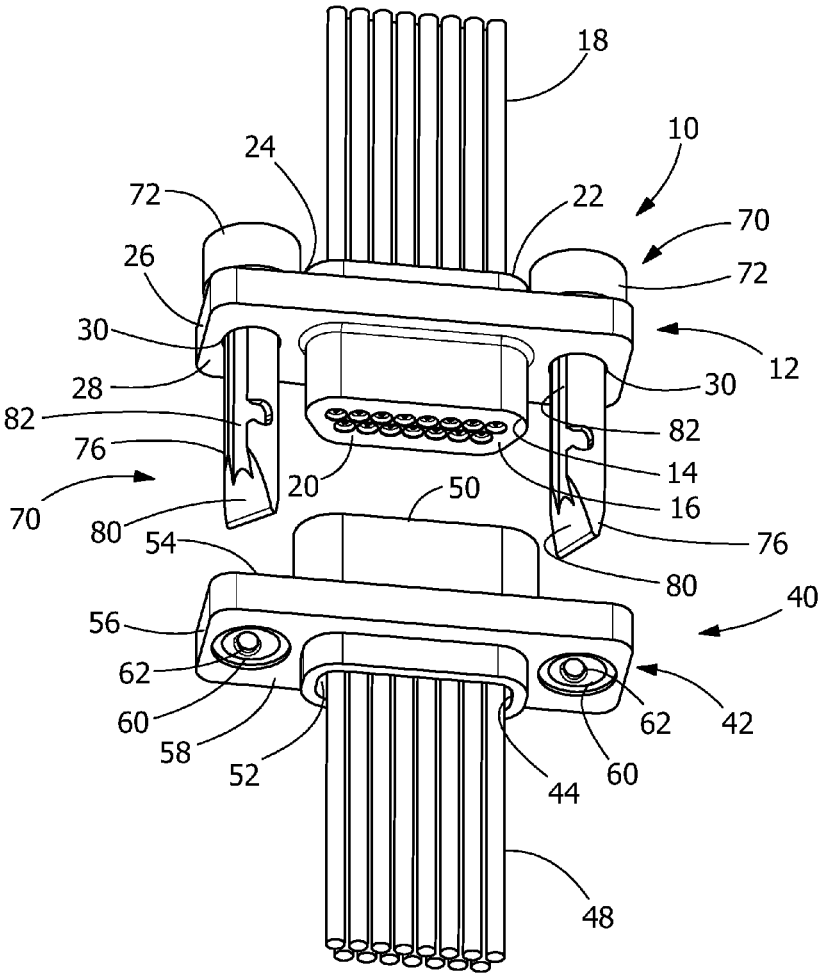
FIG. 2 is a front perspective view of the first connector and the second connector in an unmated position, an illustrative mating post according to the present invention extends from the first connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 5:
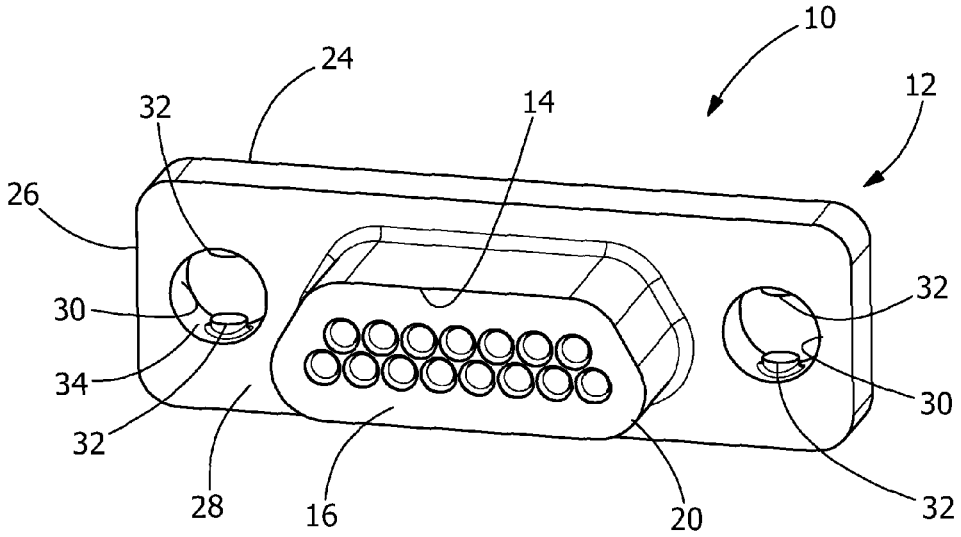
FIG. 5 is a top perspective view of the first connector.
Figure 7:
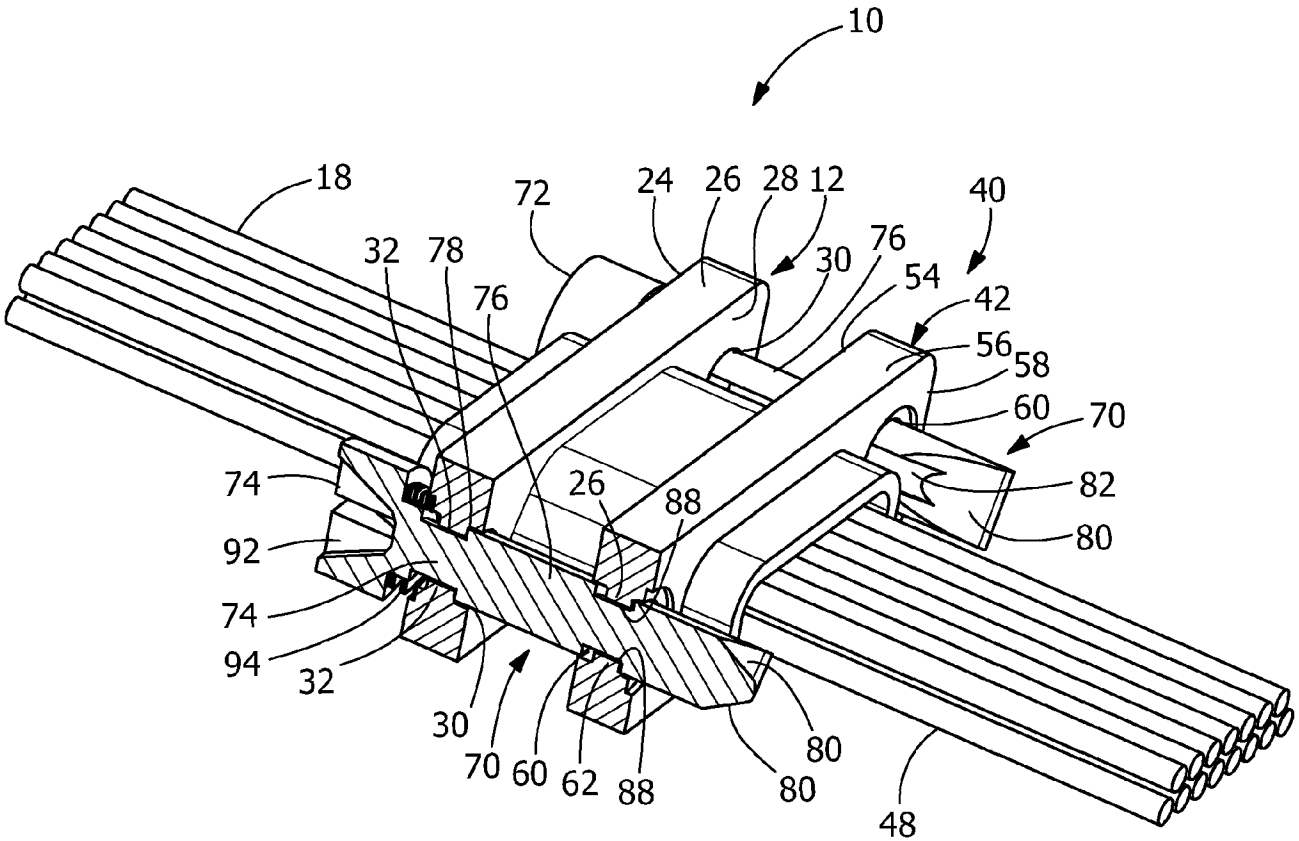
FIG. 7 a perspective cross-sectional view of the mated connectors taken along line 7-7 of FIG. 1.

Referring to FIGS. 1, 2, 5 and 7, a first connector 10 includes a housing or shell 12, having a cavity 14 for receiving an insert 16 with contacts (not shown) provided therein. The contacts are terminated to wires or cables 18. The insert 16 includes a front or mating face 20 and an oppositely facing rear or cable receiving face 22. A first or upper surface 24 of a flange 26 of the shell 12 is provided proximate to but spaced from the cable receiving face 22. A second or lower surface 28 of the flange 26 is provided proximate to but spaced from the mating face 20. Mounting openings 30, as best shown in FIGS. 5 and 7, extend through the flange 26 from the first or upper surface 24 to the second or lower surface 28. The mounting openings 30 have mating post engaging projections 32 which extend from side walls 34 of the mounting openings 30 toward the center of the mounting openings 30. In the illustrative embodiment shown, the mating post engaging projections 32 are positioned approximately 180 degrees apart.

Figure 6:
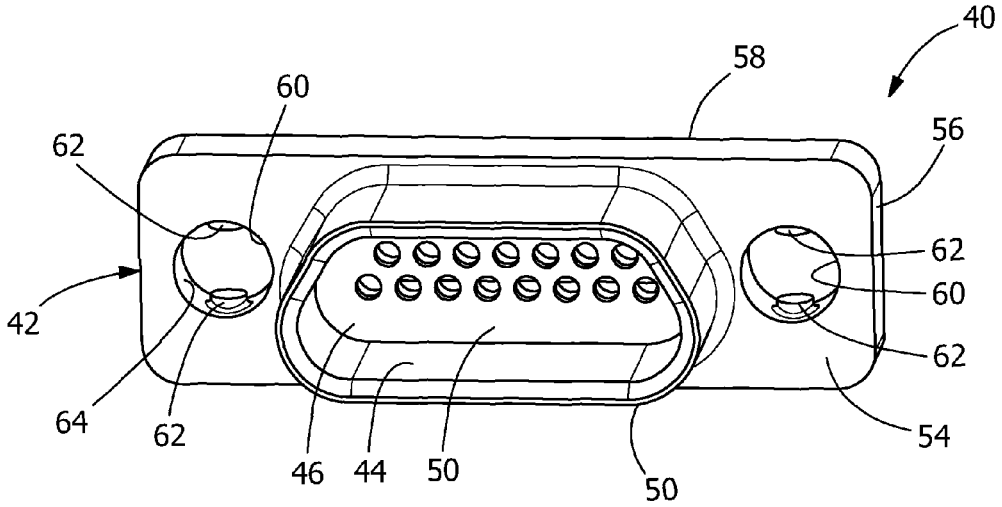
FIG. 6 is a top perspective view of the second connector.

Referring to FIGS. 1, 2, 6 and 7, a second connector 40 includes a housing or shell 42, having a cavity 44 for receiving an insert 46 (FIG. 6) with contacts (not shown) provided therein. The contacts are terminated to wires or cables 48. The insert 46 includes a front or mating face 50 and an oppositely facing rear or cable receiving face 52. A first or upper surface 54 of a flange 56 of the shell 42 is provided proximate to but spaced from the mating face 50. A second or lower surface 58 of the flange 56 is provided proximate to but spaced from the cable receiving face 52. Mounting openings 60, as best shown in FIGS. 6 and 7, extend through the flange 56 from the first or upper surface 54 to the second or lower surface 58. The mounting openings 60 have mating post engaging projections 62 which extend from side walls 64 of the mounting openings 60 toward the center of the mounting openings 60. In the illustrative embodiment shown, the mating post engaging projections 62 are positioned approximately 180 degrees apart (as best shown in FIG. 4).

Figure 3:
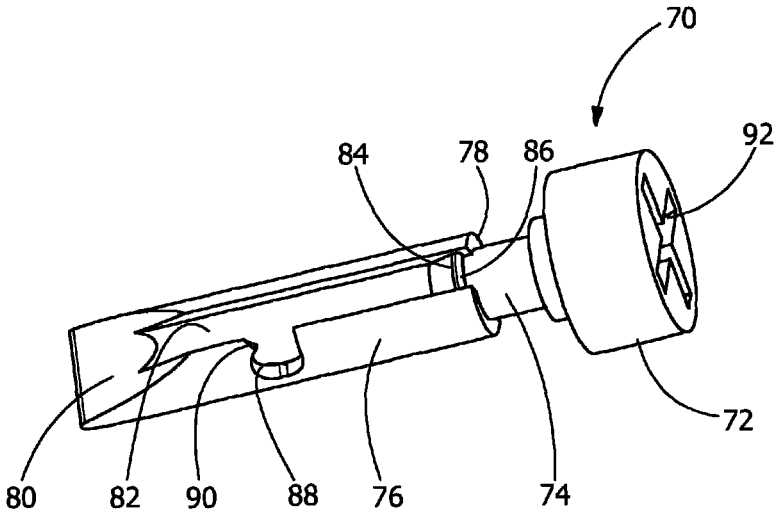
FIG. 3 is a front perspective view of the mating post shown in FIG. 2.
Figure 4:
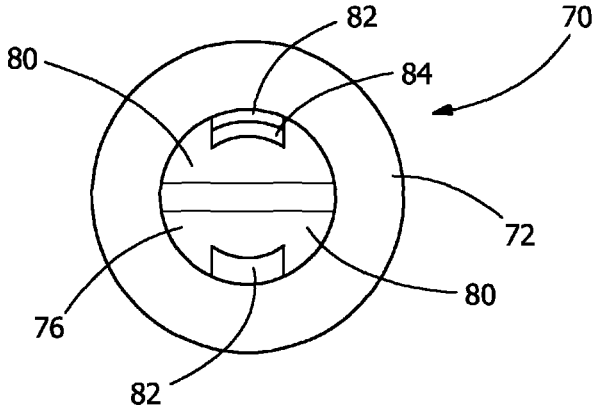
FIG. 4 is a bottom view of the mating post of FIG. 3.

Mounting hardware or mating posts 70, as best shown in FIGS. 3 and 4, include a head 72, a neck portion 74 and a locking portion 76. The locking portion 76 extends from the neck portion 74 in a direction away from the head 72. The locking portion 76 has a generally cylindrical configuration with a shoulder 78 provided proximate the neck portion 74. Sloped or lead-in surfaces 80 are provided at the free end of the locking portion 76 which is spaced from the head 72 and the neck portion 74. One or more grooves or slots 82 extend along the length of the locking portion 76 from proximate the lead-in surfaces 80 to the shoulder 78. In the illustrative embodiment shown, two grooves or slots 82 are provided and are positioned approximately 180 degrees apart.

A resiliently deformable projection 84 extends into each groove or slot 82 proximate the shoulder 78. The resiliently deformable projection 84 also includes a shoulder 86 proximate the neck portion 74.

A mating post engaging projection receiving recess or cavity 88 extends from each slot 82. Each recess 88 has a shoulder or projection 90 positioned proximate the slot 82. The shoulder or projection 90 extends from a surface of the recess 88 which is positioned closest to the lead-in surfaces 80.

The head 72 has recesses 92 provided therein for receiving a tool or the like. The neck portion 74 has an outside diameter which is less than the outside diameter of the locking portion 76.

The mounting hardware or posts 70 are made from material having composite material having the appropriate strength characteristics. The mounting hardware or posts 70 are light weight to reduce the overall weight of the connector.

In use, the mounting hardware or posts 70 are moved into position proximate the mounting openings 30 of the first connector 10. A spring 94 (FIG. 7) is positioned on the mounting hardware or posts 70 and is positioned proximate the head 72. The grooves or slots 82 of the mounting hardware or posts 70 are aligned with the mating post engaging projections 32. With the grooves or slots 82 of the mounting hardware or posts 70 aligned with the mating post engaging projections 32, the mounting hardware or posts 70 are inserted into the mounting openings 30. As this occurs, the lead-in surfaces 80 of the mounting hardware or posts 70 facilitate the centering of the mounting hardware or posts 70 in the mounting openings 30.

As the insertion of the mounting hardware or posts 70 into the mounting openings 30 continues, the resiliently deformable projections 84 engage the mating post engaging projections 32. The continued insertion causes the resiliently deformable projections 84 to resiliently deform as they engage the mating post engaging projections 32, allowing the mounting hardware or posts 70 to be fully inserted into the mounting openings 30.

In this fully inserted position, the locking portion 76 of the mounting hardware or posts 70 extends below the second or lower surface 28 of the flange 26 of the connector. The neck portion 74 of the mounting hardware or posts 70 are positioned in the mounting openings 30. The mating post engaging projections 32 are retained in the neck portion 74 of the mounting hardware or posts 70 by the head 72 and the shoulders 78 and the shoulders 86. The positioning of the mating post engaging projections 32 in the neck portion 74 secures the mounting hardware or posts 70 to the first connector 10, preventing the unwanted removal of the mounting hardware or posts 70 from the first connector 10.

The positioning of the mating post engaging projections 32 in the neck portion 74 prevents the unwanted axial movement of the mounting hardware or posts 70. However, the rotational movement of the mounting hardware or posts 70 relative to the first connector 10 is not prevented, as the mating post engaging projections 32 do not frictionally engage or bind to the walls of the neck portion 74.

With the mounting hardware or posts 70 properly mounted to the first connector 10, the mounting hardware or posts 70 and first connector 10 are moved into position proximate the mounting openings 60 of the second connector 40. The grooves or slots 82 of the mounting hardware or posts 70 are aligned with the mating post engaging projections 62. With the grooves or slots 82 of the mounting hardware or posts 70 aligned with the mating post engaging projections 62, the mounting hardware or posts 70 are inserted into the mounting openings 60. As this occurs, the lead-in surfaces 80 of the mounting hardware or posts 70 facilitate the centering of the mounting hardware or posts 70 in the mounting openings 60.

The insertion of the mounting hardware or posts 70 into the mounting openings 60 continues until the first connector 10 is fully mated to the second connector 40. In this fully inserted position, the locking portion 76 of the mounting hardware or posts 70 are positioned in the mounting openings 60. In this fully inserted position, the mating post engaging projection receiving recess 88 is aligned with the mating post engaging projections 62 of the mounting openings 60.

The mounting hardware or posts 70 are rotated or turned approximately a quarter turn to cause the mating post engaging projection receiving recess 88 to cooperate with the mating post engaging projections 62. In this position, the axial spring force provided by the springs 94, which are positioned between the heads 72 and the first surface 24 of the flange 26 of the housing or shell 12, causes the mounting hardware or posts 70 to be biased toward the first connector 10, causing the mating post engaging projections 62 to engage to bottom wall of the mating post engaging projection receiving recess 88. In this position, the shoulder or projection 90 of the mating post engaging projection receiving recess 88 prevents the unwanted rotation or movement of the mating post engaging projections 62 back toward the grooves or slots 82. Therefore, the configuration of the mating post engaging projection receiving recess 88 and the use of the spring 94 causes the mating post engaging projections 62 to be retained in the mating post engaging projection receiving recess 88, thereby securing the first connector 10 to the second connector 40.

If the first connector 10 is not fully mated or inserted with the second connector 40, the mating post engaging projection receiving recess 88 will not align with the mating post engaging projections 62, preventing the mounting hardware or posts 70 from being rotated or turned. This alerts the operator or user that the connectors are not properly mated.

To unmate the first connector 10 from the second connector 40, the heads 72 of the mounting hardware or posts 70 are engaged and pushed toward the front face 24 of the flange 26, thereby overcoming the spring force associated with spring 94. As this occurs, the mounting hardware or posts 70 are rotated approximately a quarter turn (in the direction opposite to the direction of mating) to cause the mating post engaging projection receiving recess 88 to move away from the mating post engaging projections 62, positioning the mating post engaging projections 62 in the grooves or slots 82. This allows the mounting hardware or posts 70 to be retracted or removed from the mounting openings 60, which allows the first connector 10 to be unmated from the second connector 40.

In summary, an illustrative method of retaining the first electrical connector 10 to the a second electrical connector 40 includes: aligning slots 82 in the mounting hardware or posts 70 with first projections 32 in the first mounting opening 30 of the first connector 10; inserting the mounting hardware or posts 70 through the first mounting opening 30 of the first connector 10; rotating the mounting hardware or posts 70 relative to the first mounting opening 30 of the first connector 10 to secure the mounting hardware or posts 70 in the first mounting opening 30 of the first connector 10.

The method also includes: aligning the slots 82 in the mounting hardware or posts 70 with second projections 62 in the second mounting opening 60 of the second connector 40; inserting the mounting hardware or posts 70 through the second mounting opening 60 of the second connector 40; rotating the mounting hardware or posts 70 relative to the second mounting opening 60 of the second connector 40 to position the second projections 62 in projection receiving recesses 88 of the mounting hardware or posts 70 which extend from the slots 82. The mounting hardware or posts 70 are secured in the second mounting opening 60 of the second connector 40 while maintaining the mounting hardware or posts 70 in the first mounting opening 30 of the first connector 10.

The method may additionally include: biasing the mounting hardware or posts 70 to prevent in the unwanted removal of the mounting hardware or posts 70 from the first connector 10 and the second connector 40; providing projections 90 in the projection receiving recesses 88 to prevent the unwanted removal of the second projections 62 from the projection receiving recesses 88; and/or resiliently deforming projections 84 positioned in the slots 82 to retain the mounting hardware or posts 70 in the first connector 10.

The mounting hardware, as described and claimed herein, is self-aligning and utilizes a quarter-lock, bayonet type action to eliminate the need for the back-and-forth turning of screws required in the known art. The mounting hardware can be made of composite material to greatly reduce the weight compared to the known mounting hardware.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A mating post for use to retain a first electrical connector to a second electrical connector, the mating post comprising:

a head, a neck portion configured to be received in a mounting opening of the first connector;

a locking portion extending from the neck portion in a direction away from the head;

at least one slot provided in the locking portion, the at least one slot projecting from proximate a free end of the locking portion toward the neck portion, a projection receiving recess extending from the at least one slot to cooperate with a projection of the second connector to secure the first connector to the second connector;

a shoulder provided proximate the neck portion, the neck portion has an outside diameter which is less than an outside diameter of the locking portion.

2. The mating post as recited in claim 1, wherein the locking potion has a lead-in surface provided at the free end of the locking portion.

3. The mating post as recited in claim 2, wherein the at least one slot extends along the length of the locking portion from proximate the lead-in surface to a shoulder provided proximate the neck portion.

4. The mating post as recited in claim 1, wherein the at least one slot is two slots positioned approximately 180 degrees apart.

5. The mating post as recited in claim 1, wherein a resiliently deformable projection extends into the at least one slot proximate a shoulder provided proximate the neck portion.

6. The mating post as recited in claim 1, wherein the projection receiving recess has a projection positioned proximate the at least one slot, the projection extends from a surface of each of the projection receiving recess which is positioned closest to the free end of the locking portion.

7. An electrical connector comprising:

a housing having a flange with a first surface and an oppositely facing second surface, the flange having mounting openings which extend through the flange from the first surface to the second surface;

mating posts retained in the mounting openings of the housing, the mating posts having slots which project from proximate free ends of the mating posts toward ends of the mating posts that are positioned proximate the housing, projection receiving recesses extending from the mounting slots to cooperate with projections of a mating connector to secure the housing to the mating connector;

springs positioned between the first surface of the flange and heads of the mating posts positioned at the ends of the mating posts that are positioned proximate the housing, the springs configured to provide an axial spring force between the heads of the mating posts and the housing.

8. The electrical connector as recited in claim 7, wherein each of the mating posts includes a head, a neck portion and a locking portion.

9. The electrical connector as recited in claim 8, wherein each of the locking portions has a generally cylindrical configuration with a shoulder provided proximate the neck portion.

10. The electrical connector as recited in claim 9, wherein each of the locking potions has a lead-in surface provided at a free end of the locking portion which is spaced from the head and the neck portion.

11. The electrical connector as recited in claim 10, wherein the slots extend along the length of the locking portions from proximate the lead-in surfaces to the shoulder.

12. The electrical connector as recited in claim 11, wherein each of the locking portions has two slots positioned approximately 180 degrees apart.

13. The electrical connector as recited in claim 12, wherein a resiliently deformable projection extends into each of the slots proximate the shoulder.

14. The electrical connector as recited in claim 13, wherein each of the projection receiving recesses has a projection positioned proximate the slot, the projection extends from a surface of each of the projection receiving recesses which is positioned closest to the lead-in surfaces.

15. The electrical connector as recited in claim 14, wherein the neck portion has an outside diameter which is less than the outside diameter of an outside diameter of the locking portion.

16. A method of retaining a first electrical connector to a second electrical connector, the method comprising:

aligning slots in a mating post with first projections in a first mounting opening of the first connector;

inserting the mating post through the first mounting opening of the first connector;

rotating the mating post relative to the first mounting opening of the first connector to secure the mating post in the first mounting opening of the first connector;

aligning the slots in the mating post with second projections in a second mounting opening of the second connector;

inserting the mating post through the second mounting opening of the second connector;

rotating the mating post relative to the second mounting opening of the second connector to position the second projections in projection receiving recesses of the mating post which extend from the slots;

wherein the mating post is secured in the second mounting opening of the second connector while maintaining the mating post in the first mounting opening of the first connector.

17. The method of claim 16, comprising:

biasing the mating post to prevent the unwanted removal of the mating post from the first connector and the second connector.

18. The method of claim 16, comprising:

providing projections in the projection receiving recesses to prevent the unwanted removal of the second projections from the projection receiving recesses.

19. The method of claim 16, comprising:

resiliently deforming projections positioned in the slots to retain the mating post in the first connector.

* * * * *